US005709031A

United States Patent [19]

Van Beek

[11] Patent Number: 5,709,031

[45] Date of Patent: Jan. 20, 1998

[54] FIRE FIGHTER'S HATCHET

[75] Inventor: Gÿs J. Jansen Van Beek, Caldwell, Id.

[73] Assignee: Spencer Products Co., Seattle, Wash.

[21] Appl. No.: 806,393

[22] Filed: Feb. 26, 1997

Related U.S. Application Data

[63] Continuation of Ser. No. 552,196, Nov. 2, 1995, abandoned.

[51] Int. Cl.[6] ..... B26B 23/00

[52] U.S. Cl. ..... 30/308.1; 7/145

[58] Field of Search ..... 30/308.1, 308.2, 30/308.3, 123; 7/145

[56] References Cited

U.S. PATENT DOCUMENTS

| | | | |
|---|---|---|---|
| D. 120,609 | 5/1940 | Arnsbarger . | |
| D. 233,405 | 10/1974 | Frey . | |
| D. 266,902 | 11/1982 | Tarran . | |
| D. 266,903 | 11/1982 | Tarran . | |
| 504,908 | 9/1893 | Bronk | 7/145 |
| 1,110,188 | 9/1914 | Currie . | |
| 1,562,154 | 11/1925 | Erickson . | |
| 1,643,861 | 9/1927 | Szakács . | |
| 2,017,447 | 10/1935 | Simmons . | |
| 2,794,251 | 6/1957 | Towne . | |
| 3,187,354 | 6/1965 | Frisbie . | |

FOREIGN PATENT DOCUMENTS

| | | |
|---|---|---|
| 2 631 576 | 11/1989 | France . |
| 2178688 | 2/1987 | United Kingdom . |
| WO 80/02004 | 10/1980 | WIPO . |

*Primary Examiner*—Douglas D. Watts

*Attorney, Agent, or Firm*—Christensen, O'Connor, Johnson & Kindness PLLC

[57] ABSTRACT

A light-weight hatchet for use by firefighters and rescue workers is disclosed. The hatchet includes a head (11) having a blade side (15) and a cutting side (17), both designed to rip and tear an obstruction, such as a roof, wall, door, etc., without becoming entangled in the obstruction. The blade (15) includes a blade having a beveled edge (23) with a relatively sharp radius of curvature that ends at rounded corners (25). The rounded corners (25) terminate at curve-back regions (27) that curve back toward the handle (13) of the hatchet. The cutting side (17) includes a pair of teeth (31, 33), one positioned outside the other. The outside tooth (31) is curved and its periphery is beveled to create a cutting edge. The slot (35) between the teeth (31, 33) is shaped such that sheets of metal and other strong materials can be cut by inserting the outer tooth (31) in a hole in the sheet and ratcheting the handle back and forth. Both the blade and cutting sides (15, 17) of the hatchet head (11) are relatively thin. Further, the blade and cutting sides (15, 17) are of substantially the same weight to balance the hatchet.

17 Claims, 4 Drawing Sheets

| DRAWING SYMBOL | DIMENSION | |
|---|---|---|
| a | 3.750 inches | |
| b | 4.375 inches | |
| c | 2.500 inches | (radius) |
| d | 0.125 inches | (radius) |
| e | 0.750 inches | (radius) |
| f | 0.675 inches | |
| g | 0.250 inches | |
| h | 0.937 inches | |
| i | 1.000 inches | (radius) |
| j | 0.150 inches | |
| k | 1.000 inches | (radius) |
| l | 4.625 inches | |
| m | 3.851 inches | |
| n | 1.500 inches | |
| o | 1.250 inches | |
| p | 2.500 inches | |
| q | 0.250 inches | |
| r | 1.318 inches | |
| s | 4.000 inches | (radius) |
| t | 1.841 inches | |
| u | 8.000 inches | (radius) |
| v | 8.000 inches | (radius) |
| w | 1.125 inches | |
| x | 0.813 inches | |
| y | 1.625 inches | |
| z | 0.625 inches | |
| aa | 0.312 inches | (radius) |
| ab | 0.125 inches | (radius) |
| ac | 2.500 inches | (radius) |
| $\alpha$ | 125° | |
| $\beta$ | 19° | |

Fig. 5.

FIRE FIGHTER'S HATCHET

This application is a continuation application of application Ser. No. 08/552,196, filed on Nov. 2, 1995 now abandoned.

TECHNICAL AREA

This invention relates to hatchets and, more particularly, to hatchets for use by firefighters and rescue personnel.

BACKGROUND OF THE INVENTION

Firefighters are often required to cut and chop through obstructions, such as roofs, walls, doors, and the like when fighting a fire. This is usually accomplished using an ax. Axes are difficult to use in many fire fighting environments due to their heavy heads and long handles. More specifically, axes are heavy and unwieldy, making them hard to carry and difficult to use under the best of circumstances. In limited space environments, such as in a hallway or a small room, it is often difficult to effectively swing an ax. Further, due to their wedge shape, even in the best of circumstances ax heads often become lodged in the obstruction being cut and chopped. Axes lodged in obstructions often require a considerable twisting and pulling force to be freed. Freeing an ax is not only a misuse of human energy, it can delay a fire-fighting operation. Consequently, there exists a need for a relatively small tool, roughly the size of a hatchet having the ability to accomplish many of the fire fighting tasks presently accomplished by axes.

In addition to firefighters, rescue workers also have need for a small easy-to-use tool suitable for gaining access to closed environments, such as the interior of an automobile, during a rescue operation. They also need a tool that can be used to close gas valves to eliminate explosion hazards.

The present invention is directed to fulfilling the foregoing needs by providing a light-weight hatchet ideally suited for use by firefighters and rescue workers.

SUMMARY OF THE INVENTION

In accordance with this invention, a light-weight hatchet for use by firefighters and rescue workers is provided. The hatchet includes a handle and a head having a blade side and a cutting side. Both sides are shaped to rip and tear an obstruction such as a roof, wall, door, etc., without becoming entangled in the obstruction.

In accordance with further aspects of this invention, the blade side includes a blade having a beveled edge and a relatively small radius of curvature that subtends a relatively large are and ends at rounded corners. The rounded corners terminate at curve-back regions that curve back toward the handle of the hatchet. The rounded corners and relatively sharp radius of curvature allow the ax to be easily used in a conventional manner to cut and rip. The rounded corners reduce the possibility of the cutting side becoming entangled.

In accordance with other aspects of this invention, the cutting side includes a pair of teeth, one positioned outside of the other with respect to the location of the handle. The outside tooth is curved and its periphery is beveled to create a cutting edge. The slot between the teeth is shaped such that when the outside tooth is inserted into a hole in a sheet of metal or other strong material, a line can be cut in the sheet of metal and other strong material by applying a ratcheting motion to the handle of the hatchet. As the handle of the hatchet is ratcheted back and forth, the tip of the inner edge of the outer tooth is pulled through the sheet and makes a cut back to the end of the slot between the teeth.

In accordance with still further aspects of this invention, both the blade and the cutting sides of the hatchet head are relatively thin. The thinness assists in preventing either side from becoming entangled in an obstruction.

In accordance with still other aspects of this invention, the blade and cutting sides are substantially the same weight. Making the blade and the cutting sides substantially the same weight balances the hatchet head.

As will be readily appreciated from the foregoing description, the invention provides a light-weight hatchet that is ideally suited for use by firefighters and other rescue workers. The hatchet is designed so as to avoid becoming easily lodged or entangled in an obstruction. Further, either side of the hatchet head can be used to chop and gouge holes in an obstruction. The blade side is ideally suited for creating larger holes in easily broken obstructions, whereas the teeth on the cutting side create holes in stronger obstructions. The teeth on the cutting side are positioned to allow the cutting side to be used to cut long slots in relatively strong sheets of material, such as an automobile top, for example. Further, the slot between the teeth can be used to grip the operating knobs of conventional gas valves, allowing such valves to be easily closed using the invention.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 5 is a table containing the dimensions of an actual embodiment of a hatchet head formed in accordance with the invention of the type illustrated in FIGS. 2–4.

DETAILED DESCRIPTION OF THE PREFERRED EMBODIMENT

Figure 1:
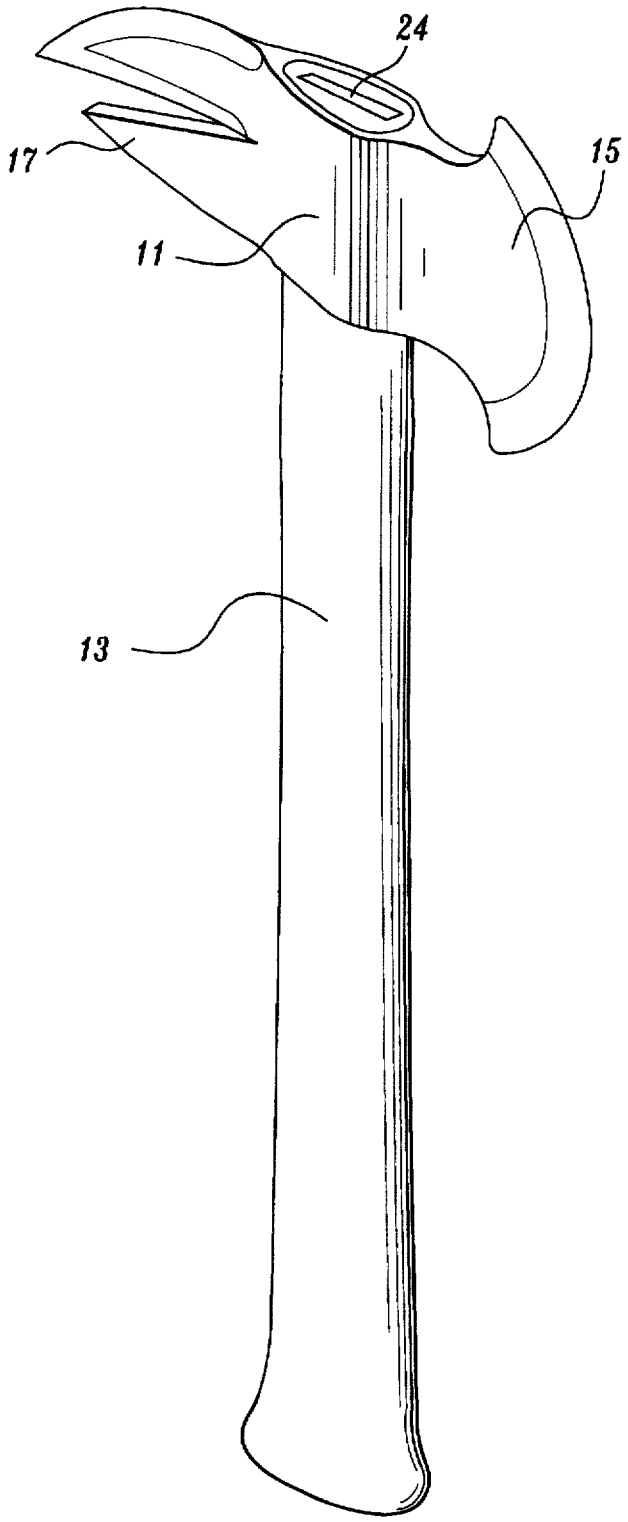
FIG. 1 is an isometric view of a hatchet formed in accordance with the invention.

As illustrated in FIG. 1, a firefighter's hatchet formed in accordance with the invention comprises a head 11 and a handle 13. While the handle 13 may be formed of any suitable wood, such as hickory, preferably, it is formed of a composite material, i.e., a material comprised of a plurality of suitably oriented fibers embedded in epoxy. The head is forged of a suitable steel.

Figure 2:
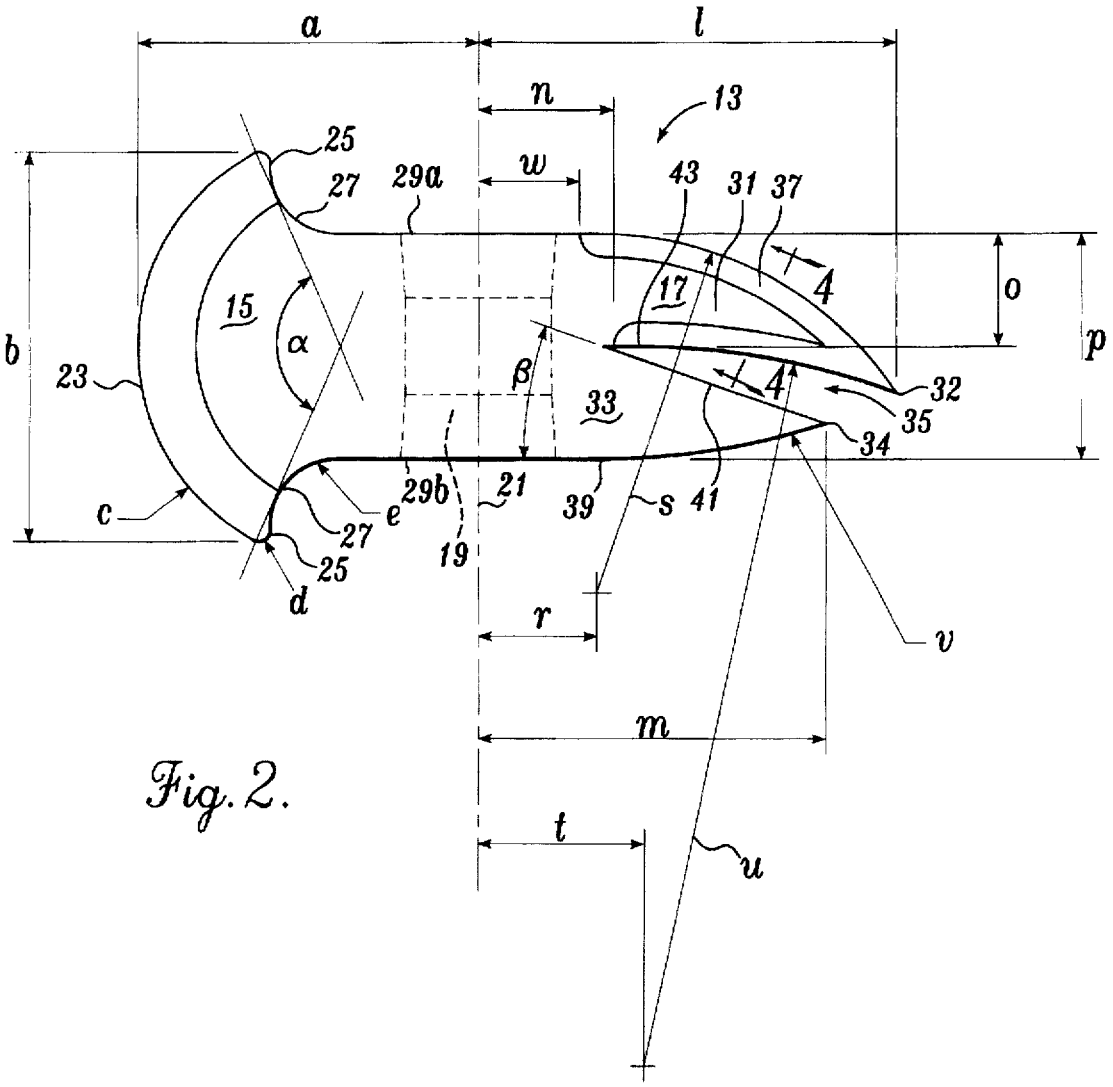
FIG. 2 is a plan view of the head of the hatchet illustrated in FIG. 1.
Figure 3:
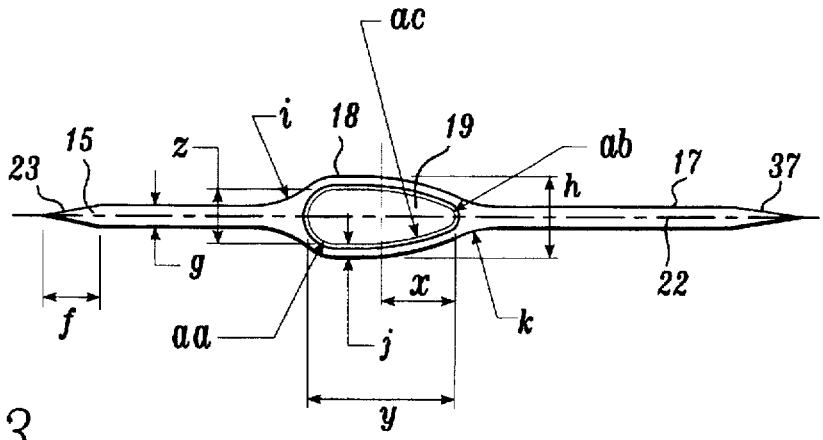
FIG. 3 is a top view of the hatchet head illustrated in FIG. 2.
Figure 4:
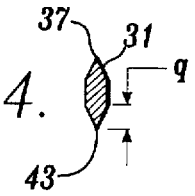
FIG. 4 is a cross-sectional view along line 4—4 of FIG. 2.

As illustrated in FIGS. 2–4, the hatchet head 13 is generally flat and has a blade side 15 and a cutting side 17. Located in an enlarged region 18 located at the center of the ax is a hole 19 sized to receive the handle 13. The centerline 21 of the hole 19 lies in a plane 22 that bisects the blade side and the cutting side. Preferably, the handle 13 is rigidly held in place in the hole 19 using a conventional retaining device, such as a suitably shaped wedge 24.

As shown in FIG. 3, both the blade side 15 and the cutting side 17 are relatively thin. The thickness of the blade side 15 and the cutting side 17 is substantially the same from their outer peripheries to the enlarged region 18 that contains the hole 19. Further, the mount of material in both sides is substantially the same, whereby the head is balanced around the centerline 21 of the hole 19.

The blade side 15 terminates at a beveled edge 23 having a relatively small radius of curvature, c, when compared to the radius of curvature of the beveled edge of many hatchets. In this regard, FIG. 5 is a table of the dimensions of the hatchet head of one actual embodiment of the invention, related to FIGS. 2–4 by symbols. In this actual embodiment of the invention, the chosen radius of curvature, c, was 2.50 inches. While this radius of curvature and the other dimensions contained in FIG. 5 are presently preferred, it is to be understood that these dimensions should be taken as exemplary and not limiting.

The beveled edge 23 of the blade side 15 subtends an angle, α, which, as shown in FIG. 5, is preferably approximately 125 degrees. The beveled edge 23 terminates at rounded corners 25. The rounded corners merge into curve-back regions 27 that terminate at parallel edges that define the inner and outer ends **29*a* and 29*b* of the main body of the head 13. As shown in FIGS. 2 and 5, preferably, the distance, a, between the centerline 21 of the hole 19 and the outer edge of the beveled edge 23 is approximately 3.75 inches. The beveled edge 23 spans a distance, b, of approximately 4.375 inches. The radius of curvature, d, of the rounded corners is approximately 0.125 inches and the radius of curvature, e, of the curve back region is approximately 0.75 inches. The preferred distance, p, between the parallel ends 29*a* and 29*b*** is approximately 2.50 inches. As noted above, it is to be understood that these dimensions, which define one actual embodiment of the invention, should be taken as exemplary, not as limiting.

The cutting side 17 of the hatchet head 13 illustrated in FIGS. 2–4 includes, with respect to the handle 13, an outer tooth 31 and an inner tooth 33. Located between the inner and outer teeth 31 and 33 is a slot 35. The outer tooth 31 curves downwardly starting at the upper parallel end **29*a* and the inner tooth 33 curves upwardly starting at the inner parallel end 29*b*. The radius of curvature, s, of the outer edge 37 of the outer tooth 31 in the actual embodiment of the invention depicted in the table shown in FIG. 5 is 4.00 inches. The center of the radius of curvature is offset from the centerline 21 in the direction of the cutting side 17** by a distance, r, that equals 1.318 inches in the embodiment of the invention depicted in the table.

The tip 32 of the outer moth 31 is spaced from the centerline 31 by a distance, 1, that equals 4.625 inches in the embodiment of the invention set forth in the table (FIG. 5). The radius of curvature, v, of the outer edge 39 of the inner tooth 33 is 8.00 inches in this embodiment of the invention. Further, the tip 34 of the inner tooth 33 is spaced by a distance, m, from the centerline 21 that equals 3.851 inches in this embodiment. The inner edge 41 of the inner tooth 33 is straight in subtends, an angle, β, that equals 19 degrees in the embodiment of the invention depicted in the table (FIG. 5). The inner edge 43 of the outer tooth 31 is curved. The radius of curvature, u, in the actual embodiment of the invention illustrated in the table equals 8.00 inches. The center of the radius of curvature is offset from the centerline 21 in the direction of cutting side 17 by a distance, t, that equals 1.841 inches in the embodiment of the invention depicted in the table. Finally, in the embodiment of the invention depicted in the table, the distance, n, between the point where the outer and inner teeth 31 and 33 meet and the centerline is approximately 1.50 inches.

As shown in FIG. 4, the periphery of the outer tooth 31 is beveled to create a cutting edge. The bevel begins at a distance, w, of approximately 1.125 inches from the centerline 21 in the embodiment of the invention depicted in the table and extends around the outer and inner edges 37 and 43 of the outer tooth 31. Preferably, the bevel has a depth of approximately 0.250 inches.

In operation, the blade side 15 of the hatchet head is used in a conventional manner to hack, chop and cut. The sharp radius of curvature of the beveled edge 23 assists in cutting. The rounded corners 25 assist in preventing the beveled edge and, thus, the blade side from becoming entangled in obstructions.

Figure 6A:
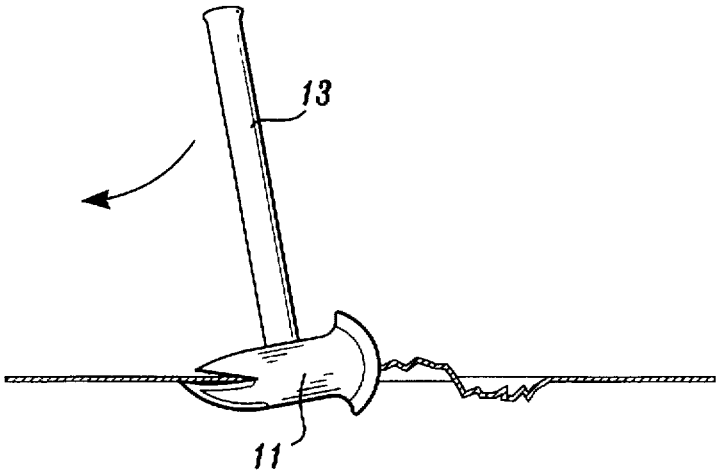
FIGS. 6A–6C are a sequence of pictorial diagrams showing the hatchet depicted in FIGS. 1–4 being used to cut a sheet of material.
Figure 6B:
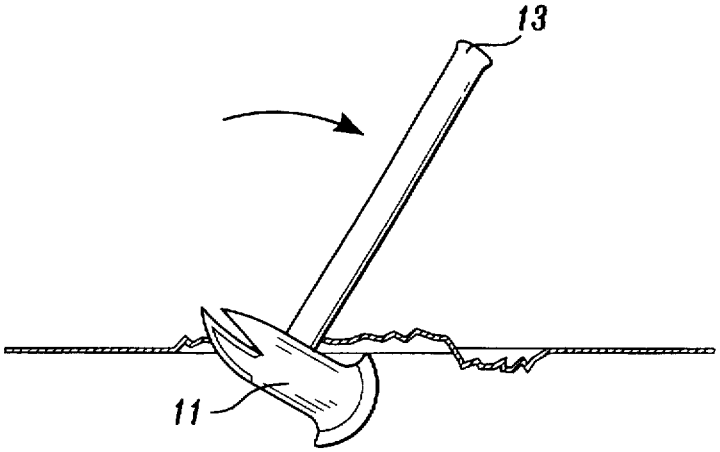
Figure 6C:
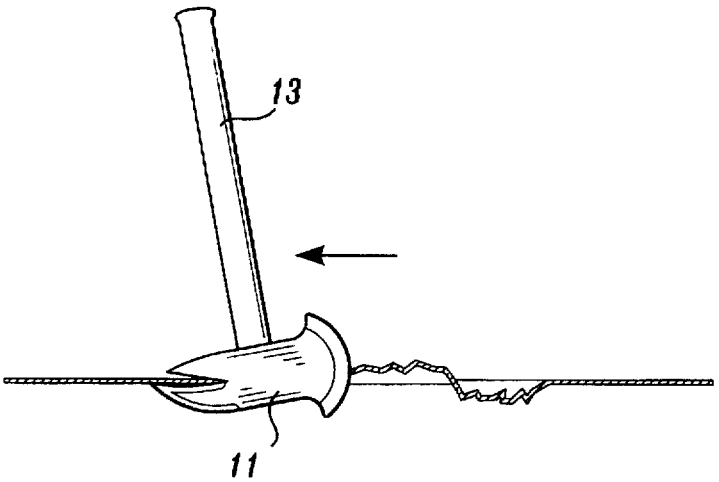

Like the blade side, the cutting side 17 can be used to hack, chop and cut. Further, the cutting side can be used to cut sheets of metal and other relatively strong sheets of material. First, the tip 32 of the outer tooth 31 is used to chop a hole in a sheet to be cut. Then the outer tooth is inserted into the hole such that the handle 13 of the hatchet points outwardly and the inner tooth is positioned outside the sheet and the outer tooth is positioned inside. Then, as shown in FIGS. 6A–6C, the handle is ratcheted back and forth to cut a line in the sheet of material. More specifically, first as shown in FIG. 6A, the handle is pushed away from a user and the metal slid between the teeth. Then, as shown in FIG. 6B, the handle is pulled back to cut a hole in the sheet of material. After a cut is made back to the original hole, the head is tilted forward and moved into the cut as shown in FIG. 6C. Then the process is repeated. The ratcheting back and forth of the hatchet head in this manner cuts a line in the sheet of material. The cutting side can also be used to close (or open) conventional gas meter valves. More specifically, the opening and dosing knobs of conventional gas valves is a flattened protrusion that readily slides between the teeth 31 and 33. The lever arm provided by the handle 13 allows a user to readily turn such a knob between valve open and closed positions.

While a preferred embodiment of the invention has been illustrated and described, it is to be understood that changes can be made therein. Consequently, it is to be understood that within the scope of the appended claims, this invention can be practiced otherwise than as specifically described herein.

The embodiments of the invention in which an exclusive property or privilege is claimed are defined as follows:

1. A fire fighters'/rescue worker's hatchet comprising:

an elongate handle; and a unitary, balanced, single-piece head, said head including a blade side and an integral cutting side lying in substantially the same plane, said blade side and said cutting side having substantially the same weight, said blade side including a curved blade having a beveled edge and a relatively small radius of curvature that subtends a relatively large arc, said cutting side including a pair of teeth, one positioned outside the other so as to define a slot therebetween, said outside tooth being curved and having a tip that extends beyond the tip of said inside tooth, the outer periphery of said outside tooth also being beveled to create a cutting edge.

2. A fire fighters'/rescue workers' hatchet as claimed in claim 1, wherein said relatively small radius of curvature is approximately 2.5 inches.

3. A fire fighters'/rescue workers' hatchet as claimed in claim 1, wherein said relatively large are is approximately 125°.

4. A fire fighters'/rescue workers' hatchet as claimed in claim 3, wherein said relatively small radius of curvature is approximately 2.5 inches.

5. A fire fighters'/rescue workers' hatchet as claimed in claim 1, wherein said blade side and said cutting side are relatively thin.

6. A fire fighters'/rescue workers' hatchet as claimed in claim 5, wherein said relatively large arc subtended by said blade ends at rounded corners.

7. A fire fighters'/rescue workers' hatchet as claimed in claim 6, wherein said relatively small radius of curvature is approximately 2.5 inches.

8. A fire fighters'/rescue workers' hatchet as claimed in claim 6, wherein said relatively large arc is approximately 125°.

9. A fire fighters'/rescue workers' hatchet as claimed in claim 8, wherein said relatively small radius of curvature is approximately 2.5 inches.

10. A fire fighters'/rescue workers' hatchet as claimed in claim 6, wherein said rounded corners terminate at curve back regions that curve back towards the handle of said hatchet.

11. A fire fighters'/rescue workers' hatchet as claimed in claim 10, wherein said relatively small radius of curvature is approximately 2.5 inches.

12. A fire fighters'/rescue workers' hatchet as claimed in claim 10, wherein said relatively large arc is approximately 125°.

13. A fire fighters'/rescue workers' hatchet as claimed in claim 12, wherein said relatively small radius of curvature is approximately 2.5 inches.

14. A fire fighters'/rescue workers' hatchet as claimed in claim 1, wherein said inside tooth has a flat surface facing said outside tooth and the inside edge of said outside tooth has a beveled cutting edge that faces said flat surface of said inside tooth.

15. A fire fighters'/rescue workers' hatchet as claimed in claim 14, wherein said relatively small radius of curvature is approximately 2.5 inches.

16. A fire fighters'/rescue workers' hatchet as claimed in claim 14, wherein said relatively large arc is approximately 125°.

17. A fire fighters'/rescue workers' hatchet as claimed in claim 16, wherein said relatively small radius of curvature is approximately 2.5 inches.

* * * * *

UNITED STATES PATENT AND TRADEMARK OFFICE

CERTIFICATE OF CORRECTION

PATENT NO. : 5,709,031

DATED : January 20, 1998

INVENTOR(S) : G.J.J. Van Beek

It is certified that error appears in the above-identified patent and that said Letters Patent is hereby corrected as shown below:

| COLUMN | LINE | |
|---|---|---|
| 4 (Claim 3, | 66 line 2) | "are" should read --arc-- |

Signed and Sealed this

Twelfth Day of May, 1998

Bruce Lehman

*Attest:*

BRUCE LEHMAN

*Attesting Officer*

*Commissioner of Patents and Trademarks*